United States Patent [19]

Kiesel et al.

[11] Patent Number: 4,623,865

[45] Date of Patent: Nov. 18, 1986

[54] CURRENT TRANSFORMER ARRANGEMENT FOR GROUND FAULT CIRCUIT INTERRUPTERS

[75] Inventors: George W. Kiesel, Burlington; Paul T. Rajotte, Plainville; LeeAnne Wambolt, Colchester, all of Conn.

[73] Assignee: General Electric Company, New York, N.Y.

[21] Appl. No.: 732,104

[22] Filed: May 9, 1985

[51] Int. Cl.[4] ..... H01F 15/02; H01F 27/30

[52] U.S. Cl. ..... 336/65; 336/82; 336/92; 336/174; 336/229

[58] Field of Search ..... 336/82, 174, 175, 229, 336/65, 200, 92; 361/42, 44, 45, 46, 47, 48, 113

[56] References Cited

U.S. PATENT DOCUMENTS

| | | | |
|---|---|---|---|
| 1,199,092 | 9/1916 | Mack | 336/82 |
| 2,829,338 | 4/1958 | Lord | 336/174 X |
| 2,862,194 | 11/1958 | Coggeshall et al. | 336/174 X |
| 3,020,502 | 2/1962 | Graham | 336/229 X |
| 3,353,130 | 11/1967 | Silverstein | 336/82 |
| 3,629,759 | 12/1971 | Douglas | 336/82 |
| 4,507,709 | 3/1985 | Morris et al. | 336/174 X |

FOREIGN PATENT DOCUMENTS

| | | | |
|---|---|---|---|
| 1563449 | 9/1977 | Fed. Rep. of Germany | 336/82 |
| 125610 | 9/1980 | Japan | 336/82 |

*Primary Examiner*—Thomas J. Kozma

*Attorney, Agent, or Firm*—Richard A. Menelly; Walter C. Bernkopf; Fred Jacob

[57] ABSTRACT

A sensing current transformer having a single turn primary winding for ground fault circuit interrupters and breakers utilizes a conductive post extending through the transformer metallic enclosure in combination with the conductive path across the metallic closure as the current sensing path. A four turn primary winding is provided by four metallic staples, each having one leg extending through the transformer aperture, for establishing four independent current sensing paths.

10 Claims, 6 Drawing Figures

CURRENT TRANSFORMER ARRANGEMENT FOR GROUND FAULT CIRCUIT INTERRUPTERS

BACKGROUND OF THE INVENTION

The invention relates to ground fault current sensing and interrupting devices wherein the circuit current is directed through a primary winding of a neutral excitation current transformer to determine the existence of a ground fault. A differential current transformer employs a pair of conductors extending through the transformer armature to sense the difference in current passing and returning through the circuit. A difference in current thereby indicating a line to ground fault within the protected circuit.

Electronic signal processing circuits are available for determining the presence of a ground fault within a protected circuit and providing a control signal to open the circuit contacts upon such an occurrence. U.S. Pat. No. 4,115,829 entitled "Overcurrent and Ground Fault Responsive Trip Unit For Circuit Breakers" in the name of E. K. Howell describes the electronic circuit within the signal processor.

U.S. Pat. No. 4,348,708 entitled "Ground Fault Circuit Interrupting Device With Improved Coordination of Electronic Circuit Operation" also in the name of E. K. Howell describes the detailed electronics required for determining such ground fault occurrence and for providing such an output signal to interrupt the circuit contacts.

One efficient means for providing a current path through concentric current transformers is described within U.S. patent application Ser. No. 579,337 filed Feb. 13, 1984 an entitled "Magnetic Sensor Module For A Ground Fault Circuit Interrupter", in the names of R. A. Morris et al. This application discloses cylindrical electrically conductive elements joined together in a pressfit relation to conduct current through the transformer apertures in parallel electrically-isolated paths.

The purpose of the instant invention is to provide a current transformer employing integral means for transporting circuit current through a current transformer aperture and having capability for electrical connection to a printed wire board without requiring additional wiring connections.

SUMMARY OF THE INVENTION

The invention comprises a single turn primary winding-multiple turn secondary winding current transformer wherein the primary winding consists of an electrically conductive post riveted to the transformer metallic closure. A separate embodiment utilizes four electrically isolated-metallic staples arranged with one leg of each of the staples passing through the transformer aperture and with the other leg passing outside the secondary winding.

DESCRIPTION OF THE PREFERRED EMBODIMENT

Figure 1:
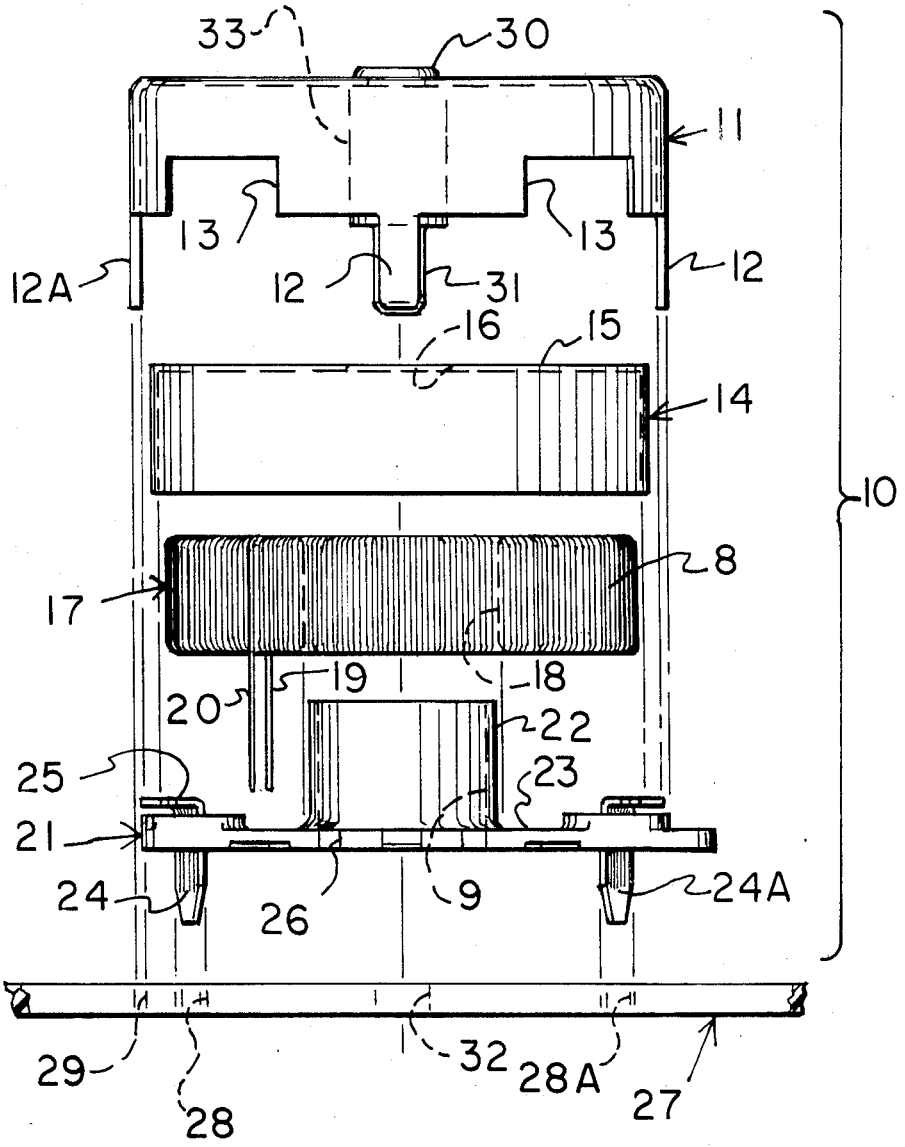
FIG. 1 is a front view of a single primary winding current transformer according to the invention with the component parts arranged in isometric projection above a printed wire board.

FIG. 1 contains a one turn primary current transformer 10 consisting of a metallic closure or can 11 having three attachment tabs 12, one conductive tab 12A and four slots 13 formed therein. The three tabs 12 are used to hold the can to the insulating support pedestal 21 and the tab 12A is used for providing electrical connection with the printed wire board 27. An insulating mylar strip formed into cylinder 14 closed at the top by a mylar washer 15 with an opening 16 concentrically arranged therein, electrically insulates the multiturn secondary winding 17 from the can 11. The secondary winding is the type wherein a plurality of wires 8 are wound around a toroidal core (not shown) through which a central aperture 18 is defined. Electrical connection with the secondary winding is made by means of a pair of wires 19, 20 which are connected with a pair of terminal ends 25 after passing through wire passage slots 26 formed in the pedestal 21. The pedestal is comprised of an insulating material such as polypropylene and includes a cylinder portion 22 with an opening 9 extending therethrough and continuing through the base 23. Electrical connection between the secondary winding 17 and the printed wire board is made by insertion of pins 24, connecting with the terminal ends 25, within the pin sockets 28 formed through the printed wire board. An additional pin 24A extending through the pedestal is inserted within an additional pin socket 28A in the printed wire board for support purposes. Electrical conduction through the opening 18 within the secondary winding 17 is provided by means of post conductor 30 attached to the top of the can 11 and having a body portion 33 coextensive with the can and having an extension 31 coextensive with the conductive tab 12A. A tab socket 29 formed within the printed wire board receives the conductive tab 12A and provides one means of electrical connection with the signal processor circuit contained on the printed wire board as described within the latter referenced Patent to E. K. Howell. The post socket 32 formed within the printed wire board receives the bottom post extension 31 to provide a second means of electrical connection with the signal processor circuit. The single turn primary winding thereby comprising the conductive path provided from the post extension 31 through the post body portion 33, along the conductive can 11, to the conductive tab 12A. When the single turn primary current transformer components are assembled together, the attachment tabs 12 are bent under the pedestal 21 to hold the can 11 to the pedestal prior to connection between the single turn primary current transformer and the printed wire board as best shown in FIG. 3.

Figure 2:
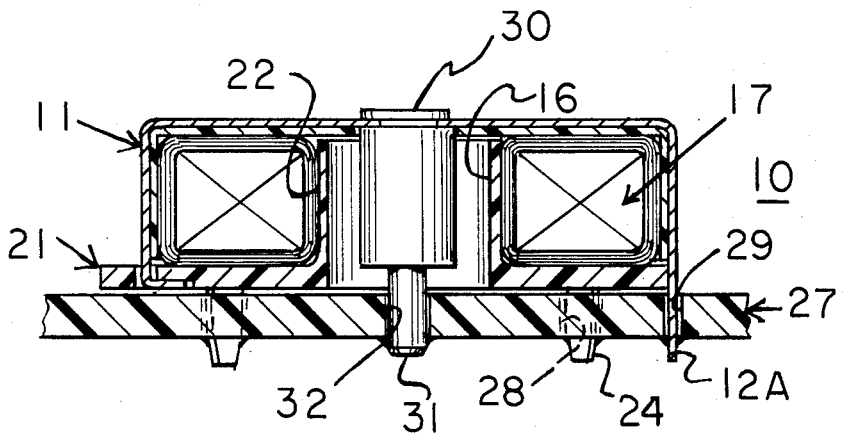
FIG. 2 is a front sectional view of the single turn primary current transformer depicted in FIG. 1 attached to the printed wire board.

The assembled single turn primary current transformer 10 is shown in FIG. 2 attached to the printed wire board 27. One electrical connection with the single turn primary winding is made by means of the conductive post 30, which is fastened at one end to can 11 and which extends through the opening 16 through cylinder 22 and connected within the post socket 32 by means of the extension 31. The other electrical connection with the single turn primary winding is provided by means of the conductive tab 12A inserted within the tab socket 29. Electrical connection between one of the wires to the secondary winding 17 and the printed wire board is made by one of the conductive pins 24 being received within one of the pin sockets 28.

Figure 3:
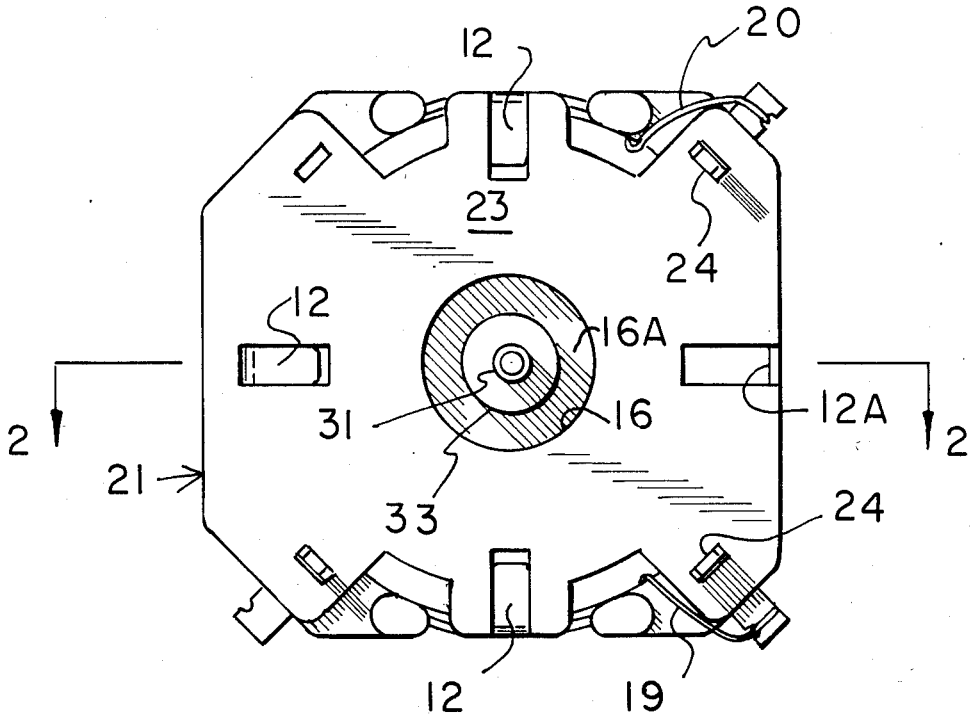
FIG. 3 is a bottom view of the assembled single turn primary current transformer of FIG. 1 prior to connection with the printed wire board.

As shown in FIG. 3 electrical isolation between the extension 31 of the post 33 and the other electrical components is provided by the air gap shown generally as 16A, within cylindrical opening 16 as well as by the polypropylene material which comprises the base 23 of pedestal 21. An insulative coating can be applied to the surface of the post body 33 if desired. The conductive tab 12A is also electrically isolated by the polypropylene material to prevent any inadvertant electrical conduction between the secondary winding terminal pins 24 shown extending from the bottom of the base and electrically connected by means of wires 19 and 20.

Figure 4:
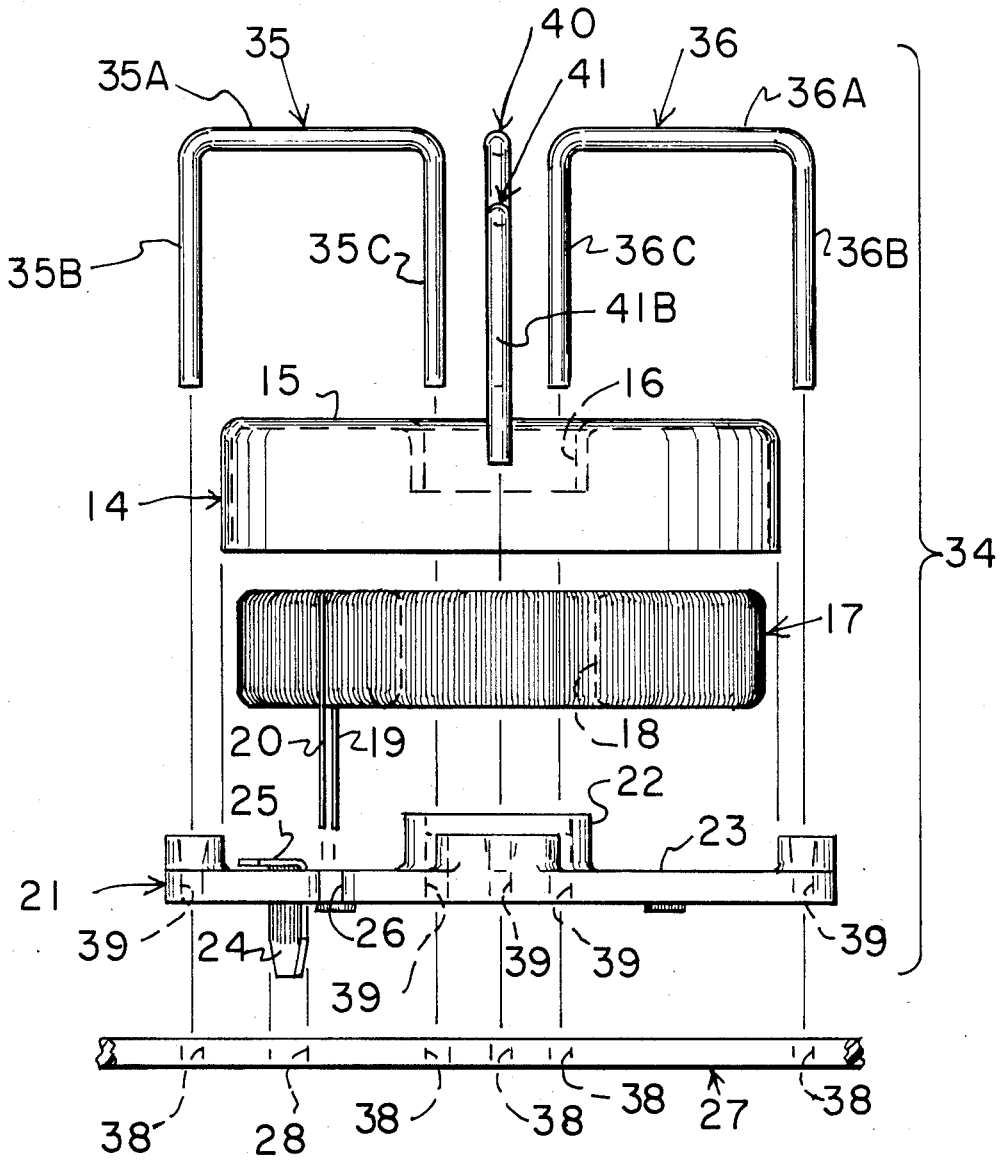
FIG. 4 is a front view of a four turn primary current transformer according to the invention with the component arranged in isometric projection prior to insertion within a printed wire board.

A four turn primary winding current transformer 34 is shown in FIG. 4 to consist of a first pair of metallic staples 35, 36 and a second pair 40, 41 arranged above an insulating cylinder 14 having a top 15 and an aperture 16 extending therethrough. The first pair of metallic staples each comprise a bight portion 35A, 36A and a pair of opposing legs 35B, 35C and 36B, 36C. Only leg 41B of the second pair of staples 40, 41 is shown. The insulating cylinder 14 electrically isolates the secondary winding 17 from the metallic staples and the secondary winding 17 is arranged on the insulating pedestal 21 by means of the cylinder 22 extending upward from the pedestal base 23 and the opening 18 through the secondary winding. The staple legs 35C, 36C extend through the aperture 16 within the top 15 of the insulating cylinder 14. To provide for improved insulation between the staple legs and to give added support, the aperture through the top can be eliminated and the staple legs can perforate the top to provide their own separate clearance slots, if so desired. Electrical connection with the secondary winding is made by means of the pair of wires 19, 20 passing through the slots 26 formed in the pedestal and connected with a pair of terminals 25 supported on the terminal base 23. Electrical connection between the secondary winding and the printed wire board 27 is made by means of connection between pins 24 extending from the bottom of the pedestal base and pin sockets 28 formed in the printed wire board. Electrical connection between the metallic staples 35, 36 is made by means of a plurality of staple sockets 38 formed in the printed wire board.

Figure 5:
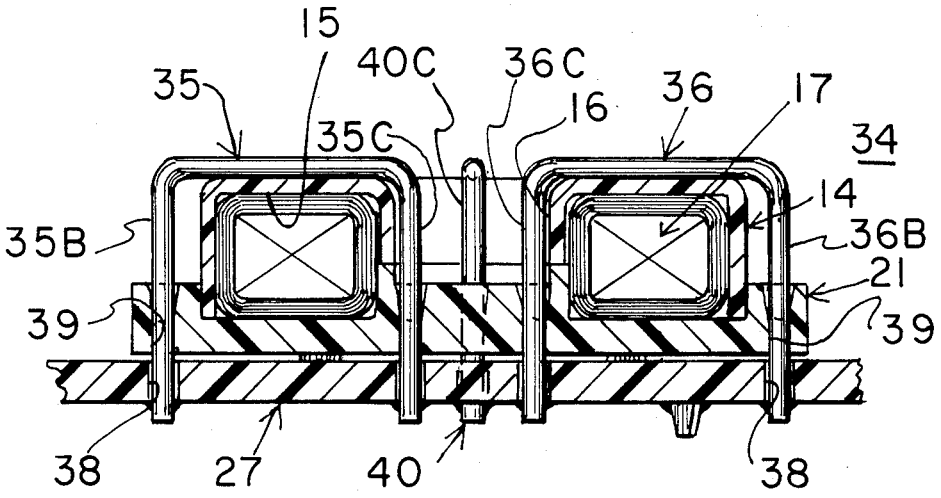
FIG. 5 is a side sectional view of the four turn primary current transformer of FIG. 4 attached to the printed wire board.

The assembled four turn primary winding current transformer 34 is shown in FIG. 5 wherein the metallic staples 35, 36 extend through the opening 16 which extends through the insulating cylinder 14 such that the staple legs 35C, and 36C are electrically separated from each other. The third metallic staple 40 having a leg 40C is also shown electrically separated from the other two conductive staples. The metallic staples are inserted through the staple holes 39 within the pedestal 21 by means of a staple machine and punch through the top 15 of the insulating cylinder for providing additional insulation and support between the metallic staples as well as setting the separation distance therebetween, if the aperture is omitted, as described earlier.

Figure 6:
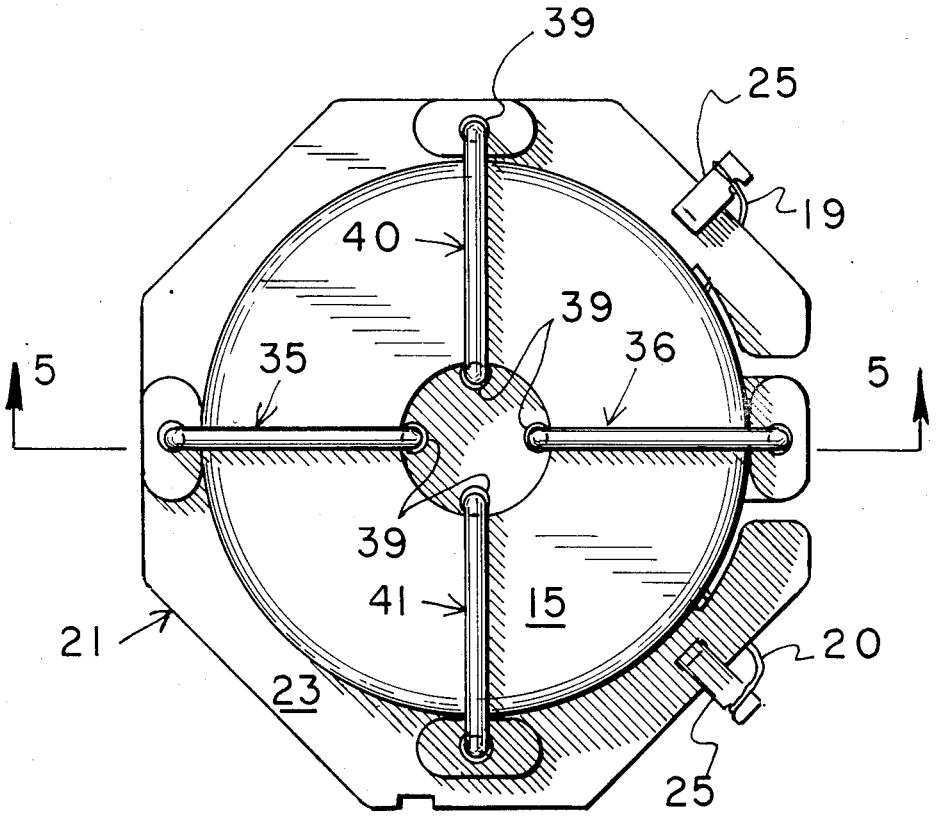
FIG. 6 is a plan view of the assembled four turn primary current transformer of FIG. 4 prior to connection with the printed wire board.

The fourth conductive staple 41 is shown in FIG. 6 along with the other metallic staples 35, 36 and 40 each of which extend through the holes 39 provided within the center and perimeter of the pedestal base 23 as indicated. The electrical terminals 25 and their connection with wires 19 and 20 are also indicated.

It has thus been shown that a single turn primary winding current transformer can be arranged whereby electrical conduction through the transformer aperture is provided by the electrical path existing between a post fastened to the transformer metallic closure and by means of a tab extending from the bottom of the closure. This arrangement lends to an automatic assembly process since no electrical wires are required for providing a sensing current transport path. A four turn primary winding current transformer wherein the metallic closure is eliminated and four conductive staples are arranged radially along the circumference of the current transformer for providing four separate and electrically insulated conductive paths through the transformer aperture has also been disclosed. This arrangement also lends to an automatic assembly process since no additional wiring is required.

Having described our invention, what we claim as new and desire to secure by Letters Patent is:

1. A current transformer arrngement having an integrally arranged single turn primary winding comprising:

electrically insulated pedestal means supporting a secondary winding arranged around an apertured core;

conductor means extending from said secondary winding for electrical connection between said secondary winding and an electrical circuit;

metallic closure means arranged over said secondary winding and having a centrally disposed conductive element electrically connected with said metallic closure and extending from said closure through said apertured core providing a single turn primary winding in an electrical conductive path outside said secondary winding;

a plurality of integrally formed tabs extending from a perimeter of said closure, at least two of said tabs being folded under said pedestal means for support and at least one of said tabs extending through said electrically insulated pedestal the end of the said central conductive element extending from said closure means and said at least one of said tabs being connected to board mounted conductors to provide said single turn in said electrical conductive path;

whereby said pedestal means provides electric insulation between said tabs and said centrally disposed conductive element.

2. The current transformer of claim 1 wherein said pedestal means comprises a planar base and an apertured cylinder extending from said planar base.

3. The current transformer of claim 1 wherein said metallic closure means comprises a hollow cylinder open at a bottom and closed at a top.

4. The current transformer of claim 3 wherein said conductive element is fastened to said top.

5. The current transformer of claim 1 wherein said conductive element comprises a solid metallic cylinder concentrically arranged within said metallic closure.

6. The current transformer of claim 1 further including electrical insulating means arranged between said metallic closure and said secondary winding to prevent electrical conduction between said metallic closure and said secondary winding.

7. The current transformer of claim 2 further including a plurality of metallic pins extending through said planar base for electrical connection with said conductor means.

8. The current transformer of claim 2 wherein said conductive element extends through said apertured cylinder for providing electrical access with said conductive element.

9. The current transformer of claim 2 further including means defining a slot through said planar base for receiving said other tab and providing electrical access to said other integrally formed tab.

10. The current transformer of claim 7 further including a printed wire board carrying said electric circuit and having socket means formed therein for receiving both said conductive element and said metallic pins to provide electrical connection between said secondary winding and said electric circuit and between said single turn primary winding and said electric circuit.

* * * * *